US005999077A

United States Patent [19]

Hammond et al.

[11] Patent Number: 5,999,077

[45] Date of Patent: Dec. 7, 1999

[54] VOLTAGE CONTROLLED VARIABLE INDUCTOR

[75] Inventors: Russell E. Hammond, La Jolla; Edward F. Rynne, San Diego; Leopold J. Johnson, Valley Center, all of Calif.

[73] Assignee: The United States of America as represented by the Secretary of the Navy, Washington, D.C.

[21] Appl. No.: 09/228,035

[22] Filed: Dec. 10, 1998

[51] Int. Cl.[6] ..... H01F 21/06

[52] U.S. Cl. ..... 336/134

[58] Field of Search ..... 323/355, 358, 323/362; 336/30, 132, 134, 165, 178, 218

[56] References Cited

U.S. PATENT DOCUMENTS 4,327,348 4/1982 Hirayama ..... 336/184
4,562,384 12/1985 Owen .
4,620,144 10/1986 Bolduc .
4,708,325 11/1987 Georges .
5,146,156 9/1992 Marcel ..... 324/127
5,347,257 9/1994 Biegel .
5,426,409 6/1995 Johnson .
5,523,673 6/1996 Ratliff et al. .
5,561,375 10/1996 Porcher .
5,585,766 12/1996 Shel .

*Primary Examiner*—Matthew Nguyen
*Attorney, Agent, or Firm*—Harvey Fendelman; Michael A. Kagan; Eric James Whitesell

[57] ABSTRACT

A voltage controlled variable inductor provides a rapidly variable inductance for high power frequency dependent circuit applications. Continuously variable inductance values having a high Q factor are obtainable with the application of only a minimal amount of control power.

5 Claims, 4 Drawing Sheets

VOLTAGE CONTROLLED VARIABLE INDUCTOR

LICENSING INFORMATION

The invention described below is assigned to the United States Government and is available for licensing commercially. Technical and licensing inquiries may be directed to Harvey Fendelman, Legal Counsel For Patents, Space and Naval Warfare Systems Center D0012, 53510 Silvergate Avenue, San Diego, Calif. 92152-5765; telephone no. (619) 553-3001; fax no. (619)553-3821.

BACKGROUND OF THE INVENTION

The present invention relates generally to variable inductors and particularly to voltage controlled variable inductors using a variable air gap to control inductance.

In certain power applications, it is desirable to vary the amount of inductance in a circuit. For example, in a circuit that has a time varying capacitive load or a varying frequency of operation, the circuit may be tuned by varying the inductance to minimize the reactive current required to be supplied by a power source. An example of a frequency dependent circuit is shown in FIG. 1. A load circuit R having an associated capacitance C is tuned by an inductor L to minimize the current supplied by a power source P. One method of changing the inductance of inductor L is by changing winding taps A, B, and C. This method is practical for applications where the frequency does not change very often, but is not effective for applications where the frequency changes rapidly such as frequency shift keyed VLF or LF transmitters.

Another example of a variable inductor 20 of the prior art is shown in FIG. 2. A control current passed through a control winding wound on a permeable core changes the inductance of an inductive winding over a range of inductance values determined by the hysteresis curve of the permeable core. A disadvantage of this method is that heavy cores may be required for high power applications, introducing corresponding energy losses.

A continuing need exists for a variable inductor having an inductance that may be varied easily and rapidly to accommodate rapid frequency changes while maintaining high energy efficiency.

SUMMARRY OF THE INVENTION

The present invention is directed to overcoming the problems described above, and may provide further related advantages. No embodiment of the present invention described herein shall preclude other embodiments or advantages that may exist or become obvious to those skilled in the art.

A voltage controlled variable inductor of the present invention provides a rapidly variable inductance for high power frequency dependent circuit applications. Continuously variable inductance values having a high Q factor are obtainable with the application of only a minimal amount of control power.

An advantage of the voltage controlled variable inductor of the present invention is that the inductance may be changed rapidly with low control power.

Still another advantage is that a high Q factor may be obtained for each selected value of inductance, i.e., the variable inductance mechanism does not involve core saturation.

Yet another advantage is that the voltage controlled variable inductor may be used to minimize power factor over a wide frequency range.

DESCRIPTION OF THE INVENTION

The following description is presented solely for the purpose of disclosing how the present invention may be made and used. The scope of the invention is defined by the claims.

Figure 1:
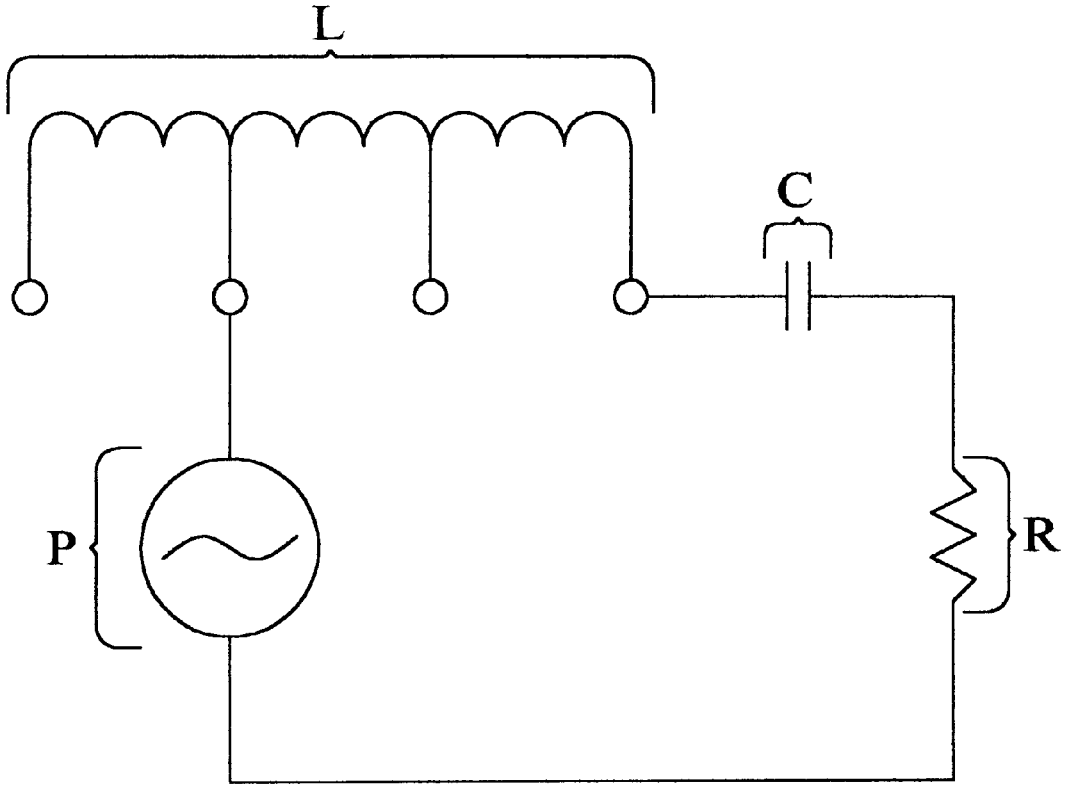
FIG. 1 (PRIOR ART)
FIG. 1 is a frequency dependent circuit that includes a variable inductor of the prior art.
Figure 2:
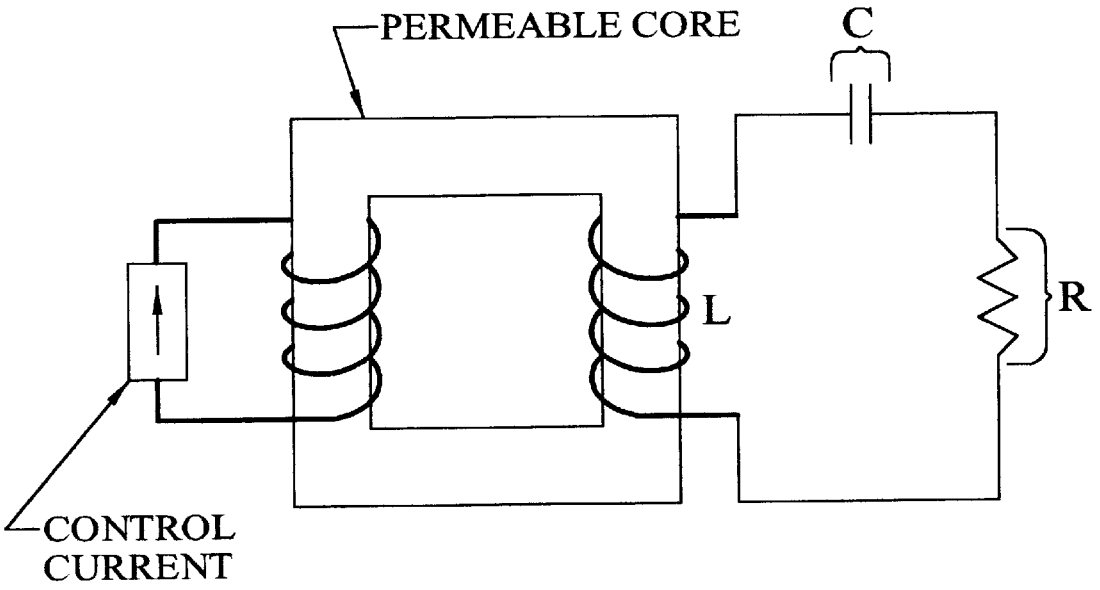
FIG. 2 (PRIOR ART)
FIG. 2 is a diagram of a current controlled variable inductor of the prior art.
Figure 3:
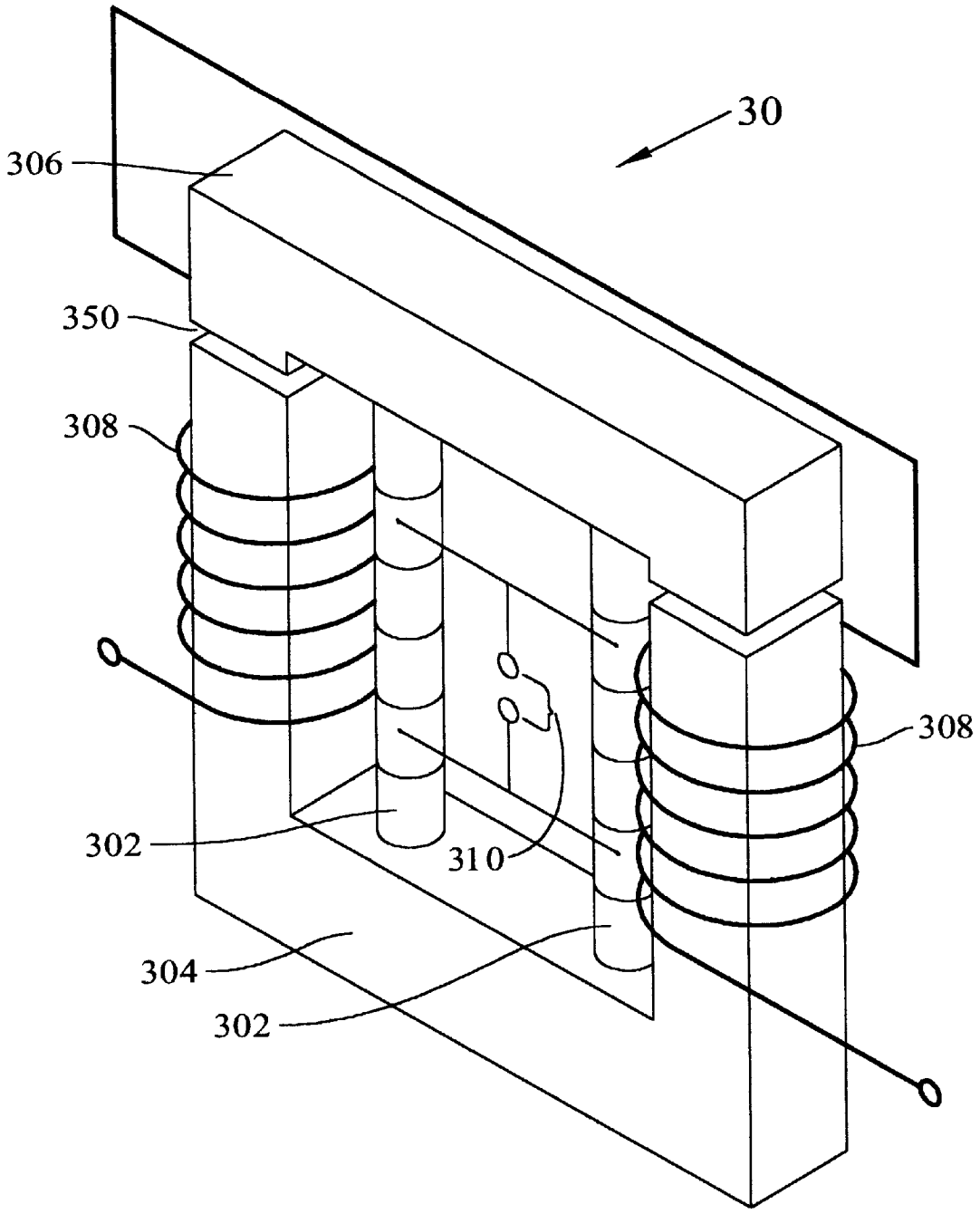
FIG. 3 is a diagram of a voltage controlled variable inductor of the present invention.

In the diagram of a voltage controlled variable inductor 30 of the present invention shown in FIG. 3, actuators 302 are fastened as shown according to well known techniques to a winding core 304 and a control core 306. Actuators 302 may be made, for example, of a piezoceramic material that changes in length in response to an applied voltage. Winding cores 304 and control core 306 are preferably made of a permeable material in a solid, laminated, or composite form according to well known techniques for making permeable inductors and transformers. A winding 308 made of an electrically conductive material is wound onto winding core 304. Winding 308 is preferably insulated from winding cores 304 to prevent shorting turns.

In operation, winding 308 transforms electrical current generated by power source P into magnetic flux that passes through winding core 304, air gaps 350, and control core 306. A control voltage applied to control voltage input 310 of actuators 302 varies the width of air gaps 350, resulting in a change in inductance of inductor 30 substantially according to the formula:

$$L = \frac{n^2 A \mu_m}{4g\frac{\mu_m}{\mu_0} + l_m},$$

where:

L=inductance, n=number of turns in winding,

A=cross sectional area of inductor cores, $\mu_m$=permeability of inductor cores, $\mu_o$=permeability of air gap, g=width of air gap, and $l_m$=mean magnetic path length.

Figure 4:
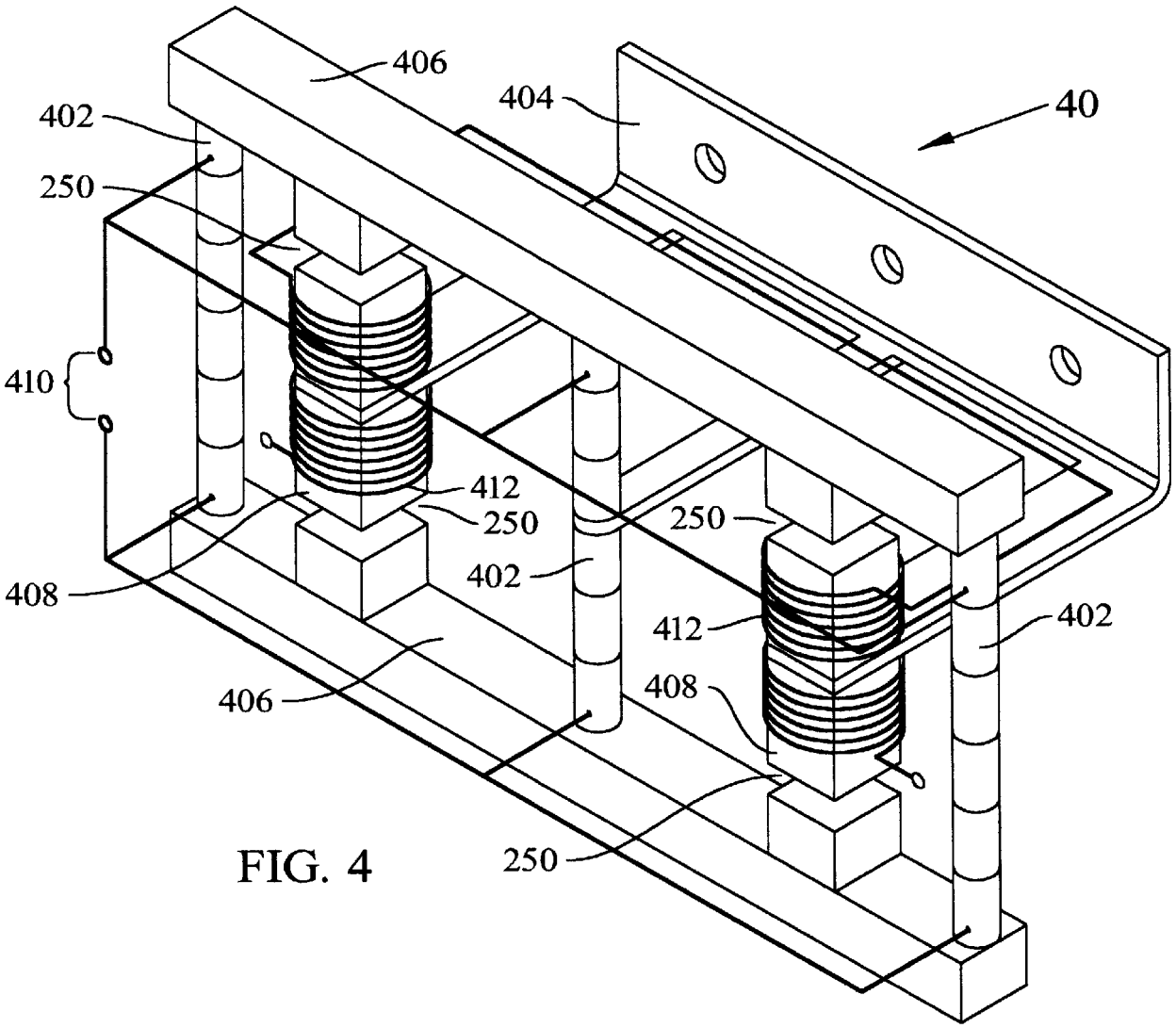
FIG. 4 is a diagram of an alternative voltage controlled variable inductor.

FIG. 4 is a diagram of an alternative voltage controlled variable inductor 40 of the present invention. In this embodiment, actuators 402 are fastened as shown to a frame 404 and to control cores 406. Winding cores 408 are mounted as shown to frame 404. An inductive winding 412 is wound as shown onto winding cores 408. The materials used for actuators 402, winding cores 408, inductive winding 412, and control cores 406 may be similar to those described above for FIG. 3.

In operation, actuators 402 expand and contract in response to a control voltage applied to control voltage terminals 410. When actuators 402 expand, air gaps 250 widen, resulting in a decrease in inductance of winding 412. When actuators 402 contract, air gaps 250 narrow, resulting in an increase in inductance of winding 412. The inductance of inductor 40 may be found using substantially the same formula as used for inductor 30 in FIG. 3.

The air gaps provide high magnetic energy storage relative to the permeable cores, therefore the size and weight of magnetic material required is greatly reduced. Because varying the width of the air gaps does not result in saturation of the cores, a high Q factor may be obtained. The dimensions of the actuators and cores may be selected to determine maximum and minimum inductance values of the conductive windings. Other mechanical configurations may be implemented conveniently to transform the actuator motion to a change in the width of the air gaps.

Modifications and variations of the present invention may be made within the scope of the following claims to practice the invention otherwise than described in the examples above.

We claim:

1. A voltage controlled variable inductor comprising:

a magnetically permeable winding core;

an electrically conductive winding coupled to the magnetically permeable core;

a magnetically permeable control core coupled to the winding core;

and a piezoelectric actuator coupled to the control core for varying an air gap between the control core and the winding core in response to a control voltage applied to the piezoelectric actuator.

2. The voltage controlled variable inductor of claim 1 further comprising a control voltage source coupled to the piezoelectric actuator.

3. The voltage controlled variable inductor of claim 1 wherein the piezoelectric actuator comprises a piezoceramic material.

4. The voltage controlled variable inductor of claim 1 further comprising a frequency dependent load circuit for coupling to a power source.

5. The voltage controlled variable inductor of claim 4 further comprising the power source.

* * * * *